United States Patent [19]

Galvin

[11] Patent Number: 4,551,857

[45] Date of Patent: Nov. 12, 1985

[54] HOT WEATHER HAT

[76] Inventor: Aaron A. Galvin, 15 Barberry Rd., Lexington, Mass. 02173

[21] Appl. No.: 450,562

[22] Filed: Dec. 16, 1982

[51] Int. Cl.[4] ..... A42B 1/24

[52] U.S. Cl. ..... 2/7; 2/185 R; 2/410; 128/399

[58] Field of Search ..... 2/7, 410, 422, 435, 2/185 R, 199, 424, 425, 10, 171.3; 165/27; 128/399

[56] References Cited

U.S. PATENT DOCUMENTS

| | | | |
|---|---|---|---|
| 2,619,643 | 12/1952 | Christensen et al. | 2/435 |
| 3,132,688 | 5/1964 | Nowak | 165/27 |
| 3,353,191 | 11/1967 | Dahly | 2/171.3 |
| 3,548,415 | 12/1970 | Waters | 2/7 X |
| 4,483,021 | 11/1984 | McCall | 2/7 |

FOREIGN PATENT DOCUMENTS

| | | | |
|---|---|---|---|
| 0050473 | 4/1982 | European Pat. Off. | 2/410 |

*Primary Examiner*—Peter Nerbun

*Attorney, Agent, or Firm*—Weingarten, Schurgin, Gagnebin & Hayes

[57] ABSTRACT

A hot weather hat is disclosed having a solar-powered Peltier-effect thermoelectric device mounted to a head-piece such that the cold surface of the thermoelectric device is in communication with the forehead of the wearer and the hot surface of the thermoelectric device is in communication with ambient atmospheric air. A thermally conductive strip provides conductive heat transport between the forehead and the cold surface. A finned radiator provides radiative and convective heat transport between the hot surface and ambient air.

11 Claims, 3 Drawing Figures

HOT WEATHER HAT

BACKGROUND OF THE INVENTION

This invention is drawn to the field of apparel, and more particularly, to a novel hot weather hat operative in response to solar radiation to cool the forehead of the wearer.

BACKGROUND OF THE INVENTION

The construction of hats have employed a variety of techniques to provide a cooling action for promoting and enhancing human comfort in hot weather. Hot weather hats typically provide the desired cooling action either by producing shade, such as in the wide-brimmed variety, or by promoting the circulation of air in a heat exchange relationship with the head. Tropical "pith" hats in which means are incorporated for maintaining the hat in a spaced apart relationship to the head, and hats fashioned from a highly porous material, are common embodiments of hot weather hats which passively permit air circulation. Dahly, U.S. Pat. No. 3,353,191, provides a hat mounted and solar powered fan operative in response to solar radiation to circulate air within the hat and over the head to actively promote air circulation. The presently available hot weather hats often are uncomfortable and have a cooling action which is limited by the available temperature differential capable of being produced by the known shading or air circulation techniques.

SUMMARY OF THE INVENTION

The novel hot weather hat of the present invention contemplates means operative to provide a temperature differential directly at a selected localized region of the cranium to reduce the temperature of the blood thereat and thereby to cool the entire body by circulation. In a preferred embodiment, a Peltier-effect thermoelectric device is mounted to a hat such that the cold side thereof is in communication with the forehead of the wearer and the hot side thereof is in communication with the surrounding air via a finned heat radiator. A plurality of solar cells mounted to the hat and connected to the thermoelectric device are operative in response to solar radiation to provide the electrical requirements for the thermoelectric device. Whenever the sun is obscured, the temperature of the cold side of the thermoelectric device is thereby raised which prevents the excessive cooling of the wearer. Whenever the sun is unobscured, the temperature of the cold side is lowered enhancing thereby the hot weather comfort of the wearer.

DETAILED DESCRIPTION OF THE DRAWINGS

The invention will become better understood by referring to the following exemplary and non-limiting detailed description of the preferred embodiment, and to the drawings, wherein.

DETAILED DESCRIPTION OF THE PREFERRED EMBODIMENT

Figure 1:
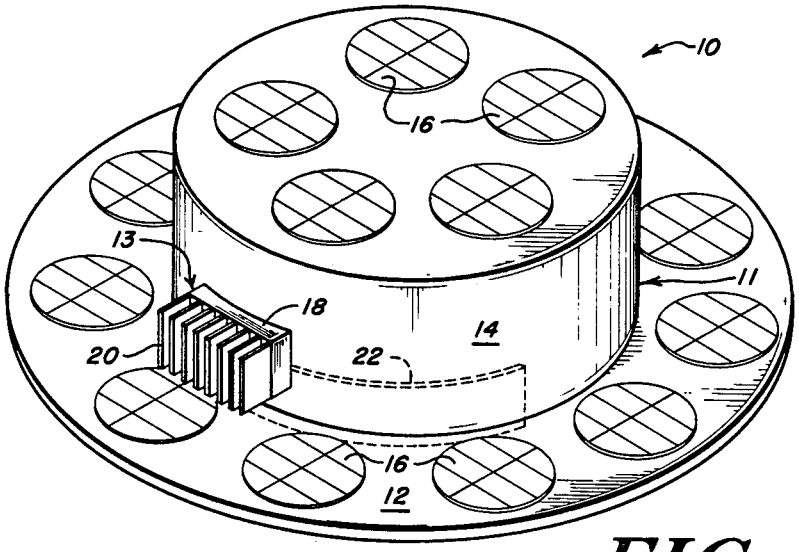
FIG. 1 shows a simplified pictorial view of the novel hot weather hat of the present invention.
Figure 2:
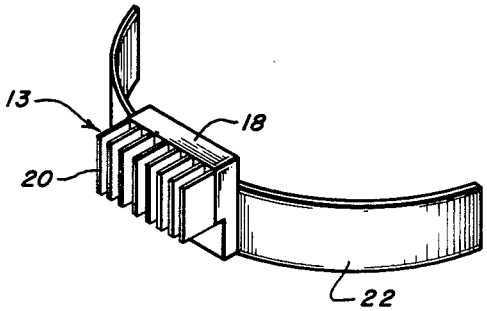
FIG. 2 shows an enlarged isometric view of the cooling subassembly of the hot weather hat of FIG. 1.

Referring now to FIGS. 1 and 2, generally designated at 10 is a novel hot weather hat according to the present invention. The hot weather hat includes a headpiece subassembly generally designated 11 and a cooling subassembly generally designated 13 mounted thereto. The headpiece 11 preferably includes a hat having a brim portion 12 and a crown portion 14 although it will be appreciated that any suitable headpiece can be employed without departing from the inventive concept. A plurality of solar cells 16 are adhesively or otherwise mounted to the top of the crown 14 and/or to the brim 12 such that the light responsive surfaces thereof are exposed to the sun. Any suitable solar cell such as a Solarex 44T229 may be utilized.

The cooling subassembly 13 includes a Peltier-effect thermoelectric device 18 mounted between and abutting a finned heat convector and radiator 20 and a heat conductor 22. The hot side of the thermoelectric device 18 abuts the finned radiator 20 and the cold side thereof abuts the heat conductor 22. The thermoelectric device 18 can be for example a Cambion No. 3958-01. The heat conductor 22 can be a metallic strip. The thermoelectric device 18 can be fastened to both the finned radiator 20 and the heat-conductor 22 by any suitable means such as by adhesives or by threaded fasteners.

The cooling subassembly 13 consisting of the thermoelectric device 18, the finned radiator 20, and the metallic strip 22 can be mounted to the side of the crown 14 by any suitable means, the only requirement being that the metallic strip 22 be disposed internally of the hat in communication with a preselected region of the cranium, preferably the forehead of a wearer, and the finned radiator 20 be disposed exteriorly of the hat in communication with the surrounding air mass.

Figure 3:
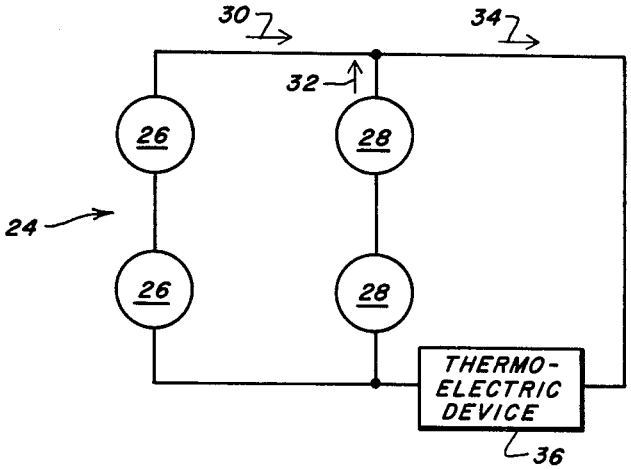
FIG. 3 shows a schematic diagram of the electrical circuit of the hot weather hat of the present invention.

Referring now to FIG. 3, generally designated at 24 is a schematic diagram of the electrical circuitry of the novel hot weather hat of the present invention. A plurality of serially connected solar cells 26, two of which are illustrated, are connected in shunt with a plurality of serially connected solar cells 28. In this manner, a current 30, produced by the solar cells 26, is summed with a current 32, produced by the solar cells 28, to provide a resultant current 34 which is applied to the thermoelectric device 36. It will be appreciated that the actual number of solar cells employed and the particular series-parallel connection thereof will depend upon the solar efficiency of the actual cells selected and upon the power requirements for the particular thermoelectric device.

In operation, solar radiation on the solar cells is converted thereby into electricity according to the photovoltaic effect. The thermoelectric device is responsive to the electrical signal and operative to transfer heat from the metallic band to the finned radiator in accordance with the Peltier-effect. Heat from the forehead of the wearer is thereby effectively dissipated into the local surrounding air mass. The net result is that the forehead of the wearer is cooled and the circulation of the cooled blood produces a desireable cooling action when the sun is present. Because of the varying current that the solar cells supply as a function of incident solar radiation, the amount of cooling is directly proportional to the need for cooling. Whenever the sun shines the strongest, the cooling capacity is the greatest; whenever the sun is obscured, such as by clouds, the cooling capacity is reduced to a lower level. In this manner, the hot weather comfort of the wearer is promoted and enhanced.

It will be appreciated that many modifications of the presently disclosed invention can be effected without departing from the scope of the appended claims.

What is claimed is:

1. Apparatus for cooling the forehead region of the cranium, comprising:

first means having photovoltaic surfaces operative in response to solar radiation to provide an electrical signal having nominal voltage and current characteristics;

second means connected to said first means and operative in response to said electrical signal having said nominal voltage and current characteristics to provide a cold surface; and third head piece means coupled to said first and said second means for removably mounting said first and said second means to the cranium;

thermally conductive metallic strip means mounted to said cold surface such that it is in physical contact with said forehead region of the cranium to provide effective thermal communication with the forehead region and cooling thereof when said third head piece means is mounted to the cranium.

2. The apparatus of claim 1, wherein said first means includes at least one solar cell.

3. The apparatus of claim 2, wherein said second means includes a Peltier-effect thermoelectric device.

4. The apparatus of claim 3, wherein said third means includes a headpiece.

5. The apparatus of claim 3, wherein said thermoelectric device has a hot surface; and further including fourth means mounted to said hot surface for providing radiative and convective heat transport.

6. The apparatus of claim 5, wherein said fourth means is a finned radiator and convector.

7. The apparatus of claim 3, wherein said second means includes means for providing conductive heat transport mounted to said Peltier-effect thermoelectric device.

8. The apparatus of claim 7, wherein said conductive heat transport means is a metallic strip.

9. A hot weather hat, comprising:

a hat having a crown portion and a brim portion;

at least one solar cell selectively mounted to at least one of said crown portion and said brim portion in position to produce an electrical signal in response to solar radiation incident thereon;

means including a Peltier-effect thermoelectric device coupled to said at least one solar cell for providing a cold surface in response to said electrical signal;

a thermally conductive metallic strip mounted to said cold surface; and said means so mounted to said crown portion that said thermally conductive metallic strip means mounted to said cold surface physically contacts the forehead of a wearer of said hat for cooling the blood present at the forehead and thereby cooling the entire body of the wearer of said hat by circulation of the cooled blood.

10. The hot weather hat of claim 9, further including means mounted to said Peltier-effect thermoelectric device for providing thermally convective and radiative heat transport.

11. The hot weather hat of claim 10, wherein said heat transport means is a finned radiator and convector.

* * * * *